US011752783B2

(12) United States Patent
Raisanen et al.

(10) Patent No.: US 11,752,783 B2
(45) Date of Patent: Sep. 12, 2023

(54) PRINT MEDIA MODES

(71) Applicant: Hewlett-Packard Development Company, L.P., Spring, TX (US)

(72) Inventors: Matthew Raisanen, Vancouver, WA (US); Jody L. Clayburn, Vancouver, WA (US); Stephen Thomas Rohman, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/256,737

(22) PCT Filed: Dec. 6, 2018

(86) PCT No.: PCT/US2018/064237
§ 371 (c)(1),
(2) Date: Dec. 29, 2020

(87) PCT Pub. No.: WO2020/117241
PCT Pub. Date: Jun. 11, 2020

(65) Prior Publication Data

US 2021/0291566 A1 Sep. 23, 2021

(51) Int. Cl.
*B41J 11/00* (2006.01)
*B41J 13/00* (2006.01)

(52) U.S. Cl.
CPC ..... *B41J 11/0024* (2021.01); *B41J 13/0009* (2013.01)

(58) Field of Classification Search
None
See application file for complete search history.

(56) References Cited

U.S. PATENT DOCUMENTS 5,297,376 A * 3/1994 Taguchi ..... B65H 39/11 53/284.3
5,946,527 A * 8/1999 Salgado ..... H04N 1/00795 399/370
6,260,941 B1 7/2001 Su et al.
7,104,627 B2 9/2006 Weast
7,172,352 B2 2/2007 Close et al.
(Continued)

FOREIGN PATENT DOCUMENTS

CN 103502011 A * 1/2014 ..... B41J 11/0015
EP 3015271 5/2016
(Continued)

OTHER PUBLICATIONS

Oguchi Hiroo, Apparatus and Method for Producing Sheet. Jul. 11, 2016, Japan, All pages (Year: 2016).*
(Continued)

*Primary Examiner* — Justin Seo
*Assistant Examiner* — Tracey M Mcmillion
(74) *Attorney, Agent, or Firm* — Brooks, Cameron & Huebsch, PLLC

(57) ABSTRACT

In some examples, a non-transitory-machine readable medium can store instructions executable by a processing resource to select a special media mode from a plurality of special media modes based on a weight or a type of print media and cause a conditioning device to condition the print media in accordance with the special media mode.

11 Claims, 8 Drawing Sheets

(56) References Cited

U.S. PATENT DOCUMENTS

| | | | | |
|---|---|---|---|---|
| 7,845,787 | B2 | 12/2010 | Synder et al. | |
| 8,774,654 | B2 | 7/2014 | Kielland | |
| 9,451,111 | B1 | 9/2016 | Bradley et al. | |
| 9,481,186 | B2 | 11/2016 | Bouverie et al. | |
| 9,579,814 | B2 | 2/2017 | Pantonial et al. | |
| 9,927,753 | B2 * | 3/2018 | Takahashi | G03G 15/6552 |
| 2008/0083726 | A1 | 4/2008 | Spence et al. | |
| 2010/0225722 | A1 | 9/2010 | Elrod et al. | |
| 2011/0043563 | A1 | 2/2011 | Houjou | |
| 2012/0162336 | A1 * | 6/2012 | Shimizu | B41J 11/00214 347/102 |
| 2013/0249979 | A1 | 9/2013 | Wing et al. | |
| 2014/0285559 | A1 | 9/2014 | Studer et al. | |
| 2015/0242172 | A1 | 8/2015 | Murphy et al. | |
| 2016/0044195 | A1 | 2/2016 | Murrell et al. | |

FOREIGN PATENT DOCUMENTS

| | | | | |
|---|---|---|---|---|
| JP | 2008275842 | A * | 11/2008 | |
| JP | 2010181469 | A * | 8/2010 | G03G 15/2039 |

OTHER PUBLICATIONS

Yamaura, Tsukasa, Inkjet Recording Device, Jan. 8, 2014, China, All pages (Year: 2014).*

Ono, Kazuro, Image Heating Device and Image Forming Apparatus, Aug. 19, 2010, Japan, All pages (Year: 2010).*

Uchiyama, Akihiko, Image Forming Apparatus, Nov. 13, 2008, Japan, All pages (Year: 2008).*

* cited by examiner

PRINT MEDIA MODES

BACKGROUND

Devices, such as printers and scanners, may be used for transferring print data on to a medium, such as paper. The print data may include, for example, a picture or text or a combination thereof and may be received from a computing device. The devices may generate an image by processing pixels each representing an assigned tone to create a halftone image.

DETAILED DESCRIPTION

Figure 1:
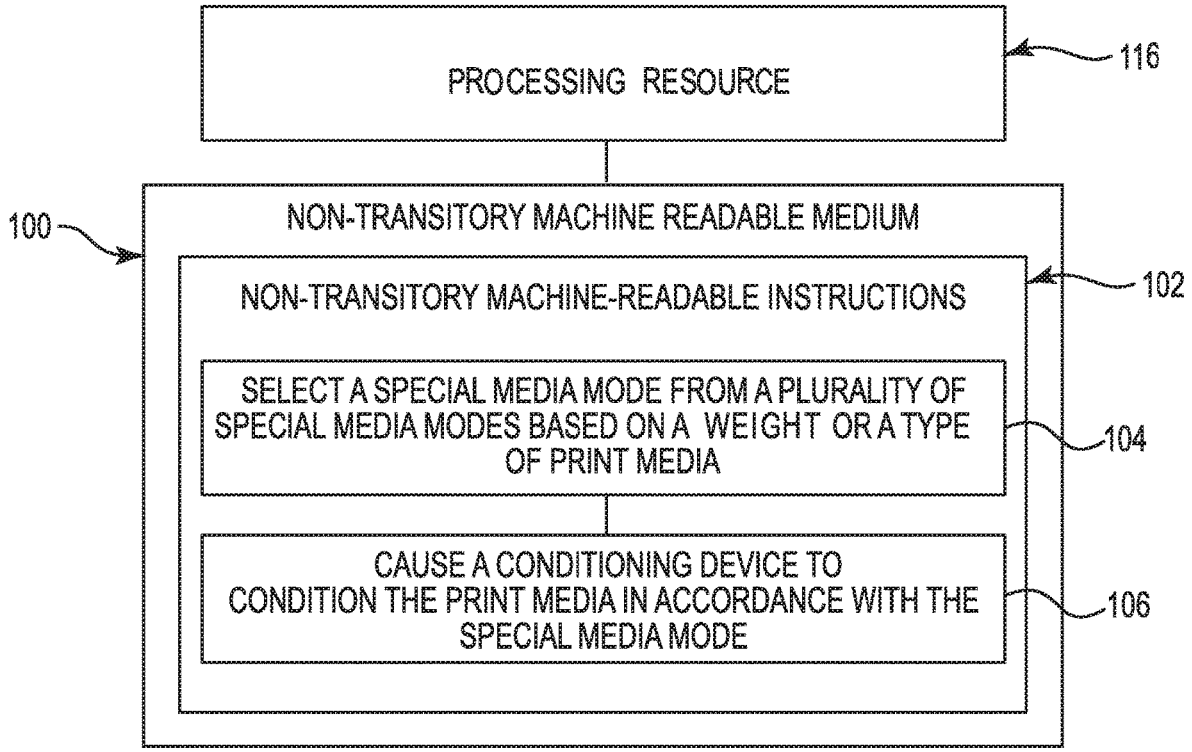
FIG. 1 illustrates a non-transitory machine readable medium storing instructions for print media modes according to an example.

An imaging system can include an imaging device such as an inkjet imaging device. The imaging device can deposit quantities of a print substance on a print media. The print substance can create a curl, and/or cockle in the print media when the print substance deposited on the print media is not completely dry. Physical properties of the print media can be changed when the print substance is deposited by the imaging system. For example, the stiffness of the print media can be changed when the print substance includes fluid droplets. The print media with deposited print substance that is not completely dry can be referred to as partially dried media.

The curl, cockle, and/or other physical properties that change due to the print substance can make finishing processes difficult, cause a print media jam, and/or inhibit print media finishing (stapled, collated, etc.). As used herein, "conditioning" refers to a process performed by the conditioning device to impart a physical change in a print media after the print substance is deposited on the print media, but in advance of any finishing operations (e.g., such as stapling, etc.). The partially dried media can provide difficulties when stacking, aligning, and/or finishing. For example, the partially dried media can have distorted properties such as a curl, a cockle, a reduction in stiffness, increased surface roughness, extruding fibers from the surface, misaligned fibers, and/or increased sheet to sheet friction of the media. The distorted properties can be caused by printing fluid deposited on the print media and the print media absorbing the printing fluid. For example, the print substance can be in a liquid state that can be absorbed by a print media such as paper. The liquid state of the print substance can cause the distorted properties of the partially dried media in a similar way that other liquids may distort the properties of the print media.

A drying zone of an imaging device can be utilized to remove the liquid and/or distorted properties from the partially dried inkjet media. The drying zone can include air flow devices, pressure rollers, heated rollers, and/or heated pressure rollers, among other devices. In some examples, a heated pressure roller (HPR) of the drying zone can be utilized to remove the distorted properties from the print media or partially dried media. For example, the HPR can be utilized to apply pressure to a surface of the partially dried media and apply heat to the surface of the partially dried media. In this example, the applied heat and pressure can remove or substantially remove the distorted properties of the partially dried media.

In some examples, the drying zone or a component of the drying zone can include a heat source (e.g., heat generating device, halogen lamp, etc.) that can be utilized to increase a temperature of the drying zone and/or a device within the drying zone such as a HPR. For example, the heat source can include a halogen lamp that can generate heat within a belt roller of a HPR. The heat source can utilize a set point temperature for a particular print job.

In some approaches the set point temperature can be utilized to remove the distorted properties for the partially dried inkjet media generated by a particular print job. In this example, the set point temperature can be based on a quantity of print substance deposited on the print media. For example, a first print job with a first quantity of print substance deposited on a print media can utilize a first set point temperature to remove distorted properties and a second print job with a second quantity of print substance deposited on the print media can utilize a second set point temperature. In this example, a greater quantity of print substance deposited on the print media can correspond to a greater set point temperature. Thus, when the first quantity of print substance is greater than the second quantity of print substance, the first set point temperature can be greater than the second set point temperature.

However, the approaches with a set point temperature based on a quantity of print substance do not account for a type and/or a weight of a print media. As such, a set point temperature that may be suitable for a given type or weight of a print media may not be suitable for other types and/or different weight of print media and therefore may lead to paper jams, curling, etc., and/or difficulties in finishing (e.g., stapling).

As such, the disclosure is directed to print media modes. Imaging devices may alter operational characteristics based on print media types (e.g., increasing resolution and print substance amounts for a high-quality print media, such as photo media, using less print substance and a lower resolution for thinner print media, etc.). Additional operational characteristics that may be altered based on print media types may include, characteristics related to how imaging devices condition print media. In one case, for instance, an example print media mode may include a set of conditioning procedures employable to condition print media. Thus, in various examples, the print media modes can be special print media modes having a different conditioning procedure than a conditioning procedure of a base print media mode. As detailed herein, a particular special media mode can be selected from a plurality of special media modes based on a weight and/or a type of print media. For instance, in some examples, a non-transitory-machine readable medium can store instructions executable by a processing resource to select a special media mode from a plurality of special media modes based on a weight or a type of print media and cause a conditioning device to condition the print media in accordance with the special media mode, as detailed herein.

FIG. 1 illustrates a non-transitory machine readable medium 100 storing instructions 102 for media modes according to an example. The instructions 102 (e.g., non-transitory machine-readable instructions (MRI)) can include instructions stored on the medium 100 and executable by a processing resource 116 to implement a function (e.g., select a special media mode from a plurality of special media modes based on a weight and/or a type of print media, etc.). The processing resource, as used herein, can include a processor capable of executing instructions stored by the medium 100. Processing resource can be integrated in an individual device or distributed across multiple devices (e.g., multiple conditioning devices and/or multiple imaging devices).

The medium 100 can be in communication with the processing resource and/or another processing resource. A medium (i.e., a memory resource), as used herein, can include components capable of storing instructions that can be executed by a processing resource. Such memory resource can be a non-transitory machine readable medium. Medium 100 can be integrated in an individual device or distributed across multiple devices. Further, medium 100 can be fully or partially integrated in the same device as a processing resource or it can be separate but accessible to that device and the processing resource. Thus, it is noted that the medium 100 can be implemented as part of or in conjunction with conditioning devices and imaging device, as described herein.

The medium 100 can be in communication with the processing resource 116 via a communication link (e.g., path). The communication link (not illustrated) can be local or remote to a device associated with the processing resource. Examples of a local communication link can include an electronic bus internal to a device where the memory resource is one of volatile, non-volatile, fixed, and/or removable medium in communication with the processing resource via the electronic bus.

As illustrated at 104, the non-transitory machine-readable medium 100 can include instructions executable by a processing resource to select a special media mode from a plurality of special media modes based on a weight and/or a type of print media. For instance, when print media is present in an imaging device and/or a conditioning device the instructions can select a special media mode from a plurality of special media modes based on a weight or a type of print media. The presence of a print media in an imaging device and/or conditioning device can be determined by a mechanical sensor such as a scale, movable arm, and/or by an optical sensor, among other possible sensors.

As illustrated at 106, the medium 100 can include instructions to condition the print media in accordance with the special media mode, as detailed herein. That is, each special media mode of the plurality of special media modes can correspond to a respective weight of print media or a respective type of print media. For instance, in some examples a special media mode can be selected based on a weight of print media. That is, in some examples, the plurality of special media modes can include a first media weight mode and a second media weight mode for print media having a different respective weights. In some examples the first media weight (i.e., the light media weight) can be a weight in a range of 74 grams or less whereas the second media weight (i.e., a heavy media weight) can be a weight in a range of 111 grams or greater, among other possible values of the first media weight and/or the second media weight. In any case, the first and second media weight modes can have different corresponding conditioning procedures, as detailed herein, to mitigate or eliminate curl, cockle and/or other unwanted physical properties tailored to a given weight of the print media.

Accordingly, in some examples, the non-transitory machine-readable medium 100 can includes instructions to determine a weight of print media. A weight of a print media can be input into a printing device (e.g., input by a user via a graphical user interface of an imaging device) and/or can be determined by a sensor. Examples of suitable sensors include those employing a scale to directly measure a weight of print media and/or a displacement mechanism whose displacement when contacted by print media is indicative of a weight of the print media, among other possible sensors.

In some examples, the non-transitory machine readable medium 100 can include instructions to select a special media mode based on type of print media, as detailed herein. That is, different types of print media can have respective media modes having different corresponding conditioning procedures, as detailed herein, to mitigate or eliminate curl, cockle and/or other unwanted physical properties tailored to the different types of print media. Examples of types of print media include a legal media mode, a photo media mode and a recycled media mode, among other possible types of print media. That is, a type of print media can refer to a size (e.g., legal sized print media) and/or a material of the print media (e.g., recycled material for a recycled media mode). Print media can be formed of paper, canvas, transparency paper, and/or recycled materials, among other materials. Print media can be offered in a variety of sizes such as letter sized (e.g., 216 mm×279 mm), A4 (e.g., 210 mm×270 mm), foolscap sized (e.g., 203 mm×330 mm), and/or legal sized (e.g., 216 mm×356 mm), etc.

Accordingly, in some examples, the non-transitory machine-readable medium 100 can include instructions to determine a type of print media. For instance, a type of print media can be input into a printing device (e.g., input by a user via a graphical user interface of an imaging device) and/or can be determined by a sensor. Examples of suitable sensors include those employing a mechanism to measure a width and/or length of print media and/or an optical sensor or other sensor to determine a width/length and/or a material of a print media, among other types of sensors to determine a type of print media. However, as mentioned in some examples a weight and/or type of print media can be provided via a user input such as a user input to a graphical user interface of an imaging device or other device or other device coupled to the imaging device.

In some examples, the non-transitory machine-readable medium 100 can include instructions to maintain a conditioning device in a special media mode until a different weight or type of print media is detected. For instance, responsive to detection of a different weight or type of print media the condition device can select a different type of special media mode (corresponding to the different weight or type of print media) or can revert the conditioning device to a base condition mode having base conditioning procedures such as a base amount of tension, base rate of print media compiling, base print media ejection rate, base print media speed, and/or base temperature of the HPR, among other possible base conditioning procedures.

Figure 2:
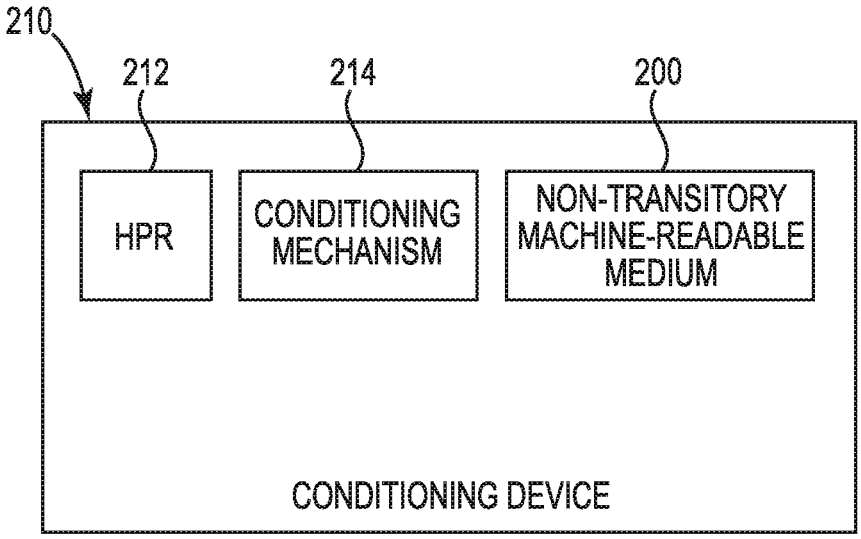
FIG. 2 is a block diagram of a conditioning device suitable for print media modes according to an example.

FIG. 2 is a block diagram of a conditioning device 210 suitable for print media modes according to an example. As used herein, a "conditioning device" refers to a device capable of conditioning print media. For instance, as illustrated in FIG. 2, the conditioning device 210 can include a HPR 212, a conditioning mechanism 214, and a non-transitory machine readable medium 200. The HPR 212 is the same or analogous to HPR 312 as described with respect to FIG. 3. The condition mechanism 214 is the same or analogous to the conditioning mechanism 314 as described with respect to FIG. 3. The non-transitory machine readable medium 200 is the same or analogous to non-transitory machine readable medium 100 and/or 300 as described in FIGS. 1 and 3, respectively.

As used herein, a HPR such as HPR 212 refers to a roller which can apply pressure and/or heat to post-printed print media to dry and/or otherwise condition the print media for subsequent finishing. As used herein, an HPR lamp may refer to a lamp, such as a halogen lamp, that can supply heat to an HPR. An amount of heat supplied to the HPR can vary, for instance based on a set point temperature of the HPR lamp. For instance, as detailed herein a HPR lamp and/or roller can have a set temperature of 110 degree Celsius (° C.) or 80° C., among other possible set temperatures.

As used herein, a conditioning mechanism refers to a device capable of performing a conditioning procedure to condition print media. In some examples, the conditioning mechanism can include a compiler, a media tensioner, a belt, an ejection mechanism, or combinations thereof.

In some examples, the medium 200 can include instructions that responsive to setting the conditioning device to the special media mode, cause the conditioning device to set a temperature of a HPR in the conditioning device to a set point temperature of the special media mode and condition the print media, via a conditioning mechanism of the conditioning device, in accordance with the special media mode. For instance, a HPR can be set to a temperature (e.g., 110° C.) that is greater than a base temperature (e.g., 80° C.) of the HPR, among other possible values of the first temperature.

Figure 3:
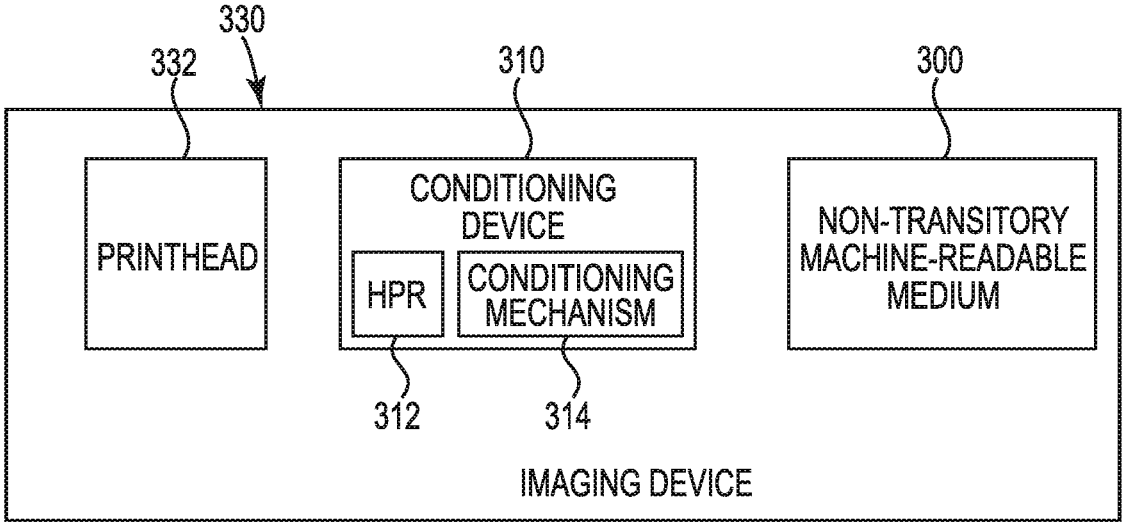
FIG. 3 is a block diagram of an imaging device suitable for print media modes according to an example.

FIG. 3 is a block diagram of an imaging device 330 suitable for print media modes according to an example. As illustrated in FIG. 3, the imaging device 330 can include a non-transitory machine-readable medium 300, a conditioning device 310 including a HPR 312 and a conditioning mechanism 314, and a printhead 332. As used herein, a printhead refers to a component that can deposit quantities of a print substance (e.g., a print fluid) on a print media.

In some examples, the imaging device 330 can include a sensor (not illustrated) to sense a weight and/or a type of print media, when present in the imaging device 330. As mentioned, suitable types of sensor include mechanical sensors and/or optical sensors, among other types of sensors.

In some examples, the non-transitory machine-readable medium 300 can include instructions executable by a processing resource to cause an imaging device to operate in accordance with a special media mode selected based on a weight or a type of print media. For instance, the imaging device operate in accordance with the special media mode by setting a temperature of the HPR in accordance with the special media mode and causing the conditioning mechanism to condition the print media in accordance with the special media mode, as described herein in greater detail. For instance, FIGS. 4, 5, 6, 7, and 8 represent examples of flow diagrams of operation of a conditioning device in accordance with examples of special media modes.

Figure 4:
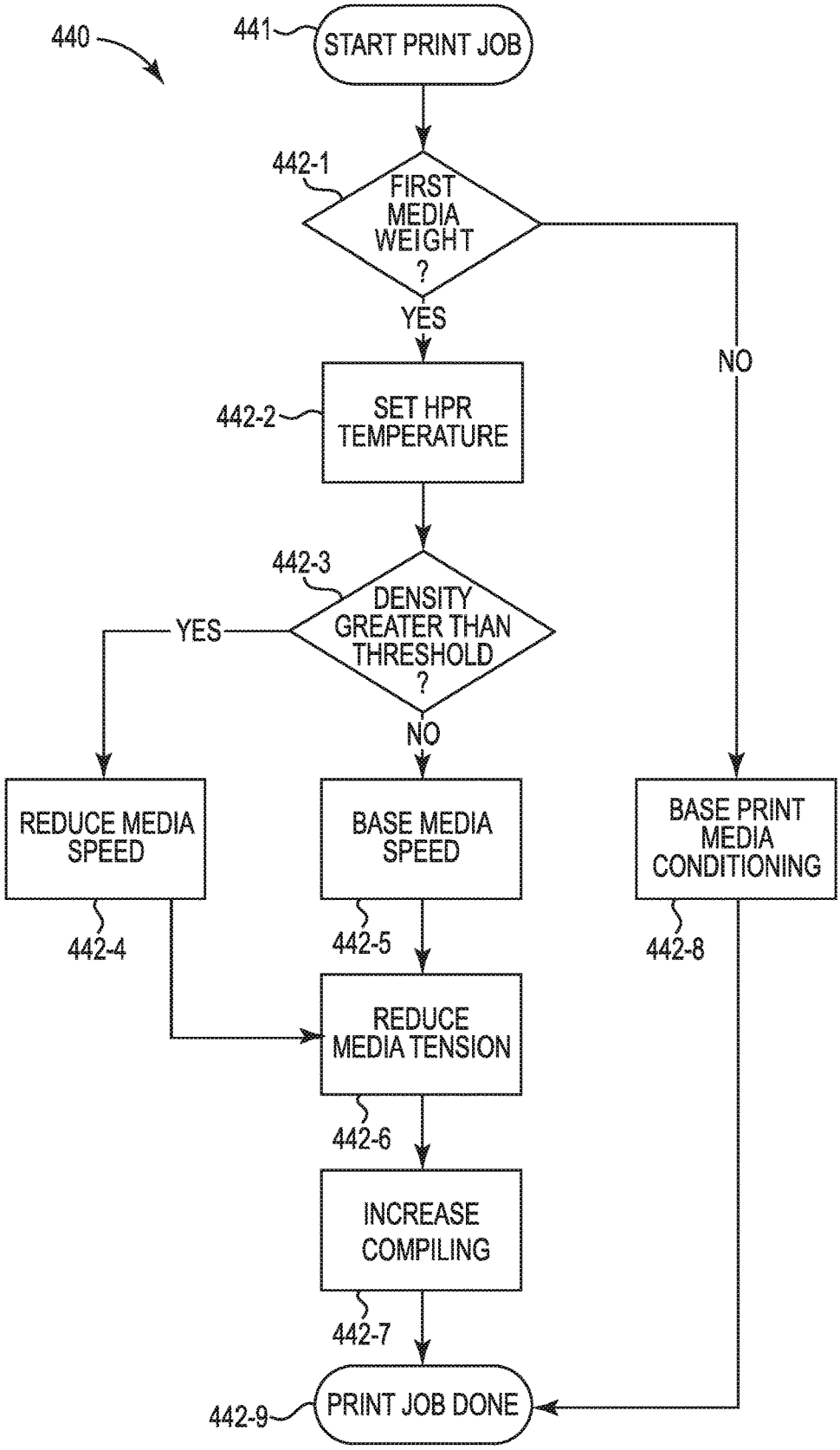
FIG. 4 is a block diagram of an example of a flow diagram of operation of a conditioning device in accordance with a first media weight mode according to an example.

FIG. 4 is a block diagram of an example of a flow diagram 440 of operation of a conditioning device in accordance with a first media weight mode according to an example. As mentioned, a type and/or weight of print media can be sensed. In some examples, a type and/or weight of a print media can be sensed in advance of and/or responsive to starting a print job. As used herein, the term "print job" may, for example, refer to an application of ink, toner, and/or other material to a print media by an imaging device to process and output the print media. For example, an imaging device may process and output a print media including physical representations, such as text, images, models, etc. As illustrated at 441, the flow diagram can begin with receipt of a print job and/or other information related to a print job.

As illustrated at 442-1 the flow diagram can include sensing whether a print media has a weight equal to or within a range of a first media weight. If yes, the flow diagram can proceed to 442-2 and the HPR temperature can be set. For example, a temperature of the HPR can be set to a first temperature (e.g., 110° C.) greater than a base temperature (e.g., 80° C.) of the HPR. The increased temperature of the HPR can facilitate timely and/or enhanced conditioning of the print media in the first print media weight mode (relative to conditioning the print media at the base temperature). Once the HPR temperature is set and/or the HPR reaches the set temperature the flow diagram can proceed to 442-3.

As illustrated at 442-3, a determination can be made whether a printing fluid density score for the print media is greater than a threshold, set a speed of the print media to first print media speed that is less than a base print media speed. The printing fluid density can be determined based on information included in or associated with a print job. As used herein, a printing fluid density score is equal to or representative of a printing fluid density on or to be applied to a print media.

If the printing fluid density score is greater than the threshold ("yes"), the flow diagram can proceed to reduce the media speed (e.g., to 2 or 3 inches per second), as illustrated at 442-4. As illustrated at 442-5 if the printing fluid density score is less than the threshold ("no"), the print media can be conditioned at a base media speed (e.g., 4 inches per second) that is greater than the reduced media speed. Such variations in speed of the print media can promote timely and/or enhanced conditioning of the print media (relative to other approaches that maintain the print media at a given speed regardless of printing fluid density).

As illustrated at 442-6, the flow diagram can apply a first amount of tension to the print media that is less than a base amount of tension (i.e., reduce media tension). The tension can be imparted to the print media via clamps, rollers, and/or other mechanical devices. For instance, in various examples no additional tension is applied to print media in the first weight mode. In any case, reduced media tension can promote timely and/or enhanced conditioning of the print media in the first print media weight mode.

As illustrated at 442-7, the flow diagram can compile the print media at a first compiling rate which is greater than a base rate of print media compiling (i.e., increase compiling). Increased compiling can promote timely and/or enhanced conditioning of the print media in the first print media weight mode.

As illustrated at 442-8, if the media weight is not equal to the first media weight (and instead is equal to a base media weight) the print media can be conditioned in accordance with base conditioning parameters, as described herein.

From 442-7 or 442-8 the flow diagram can proceed to complete the print job (i.e., print job done). In some examples, completion of the print job can include further processing and/or finishing (e.g., stapling, etc.).

Figure 5:
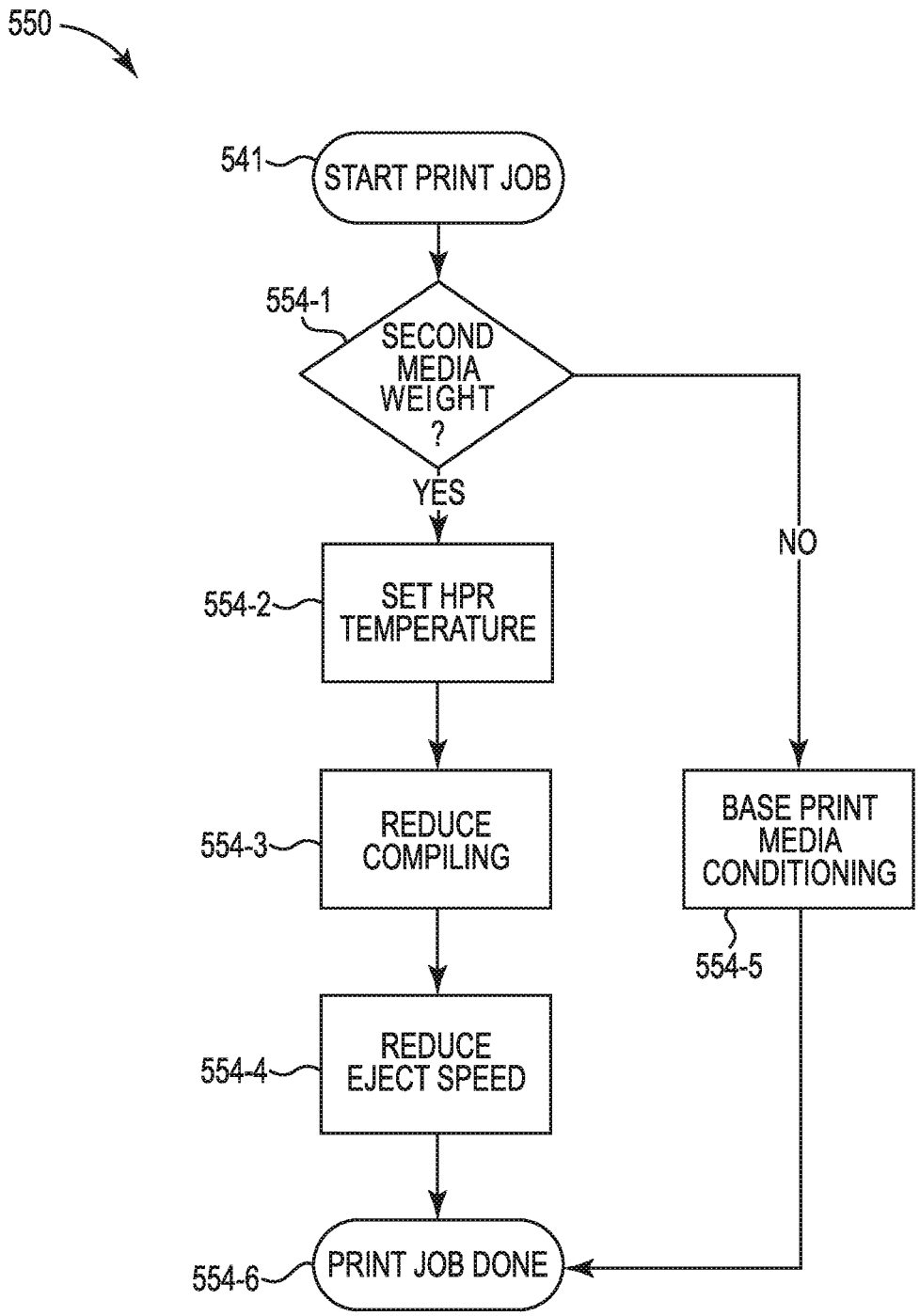
FIG. 5 is a block diagram of an example of a flow diagram of operation of a conditioning device in accordance with a second media weight mode according to an example.

FIG. 5 is a block diagram of an example of a flow diagram 550 of operation of a conditioning device in accordance with a second media weight mode according to an example. As mentioned, a flow diagram can begin with receipt of a print job and/or other information related to a print job, as illustrated at 541.

As illustrated at 554-1 the flow diagram can include sensing whether a print media has a weight equal to or within a range of a second media weight If yes, the flow diagram can proceed to 554-2 and a HPR temperature can be set. For example, a temperature of the HPR can be set to a first temperature (e.g., 110° C.) greater than a base temperature (e.g., 80° C.) of the HPR. The increased temperature of the HPR can facilitate timely and/or enhanced conditioning of the print media in the first print media weight mode (relative to conditioning the print media at the base temperature). Once the HPR temperature is set and/or the HPR reaches the set temperature the flow diagram can proceed to 554-3.

As illustrated at 554-3, the flow diagram can compile the print media at a second compiling rate which is less than a base rate of print media compiling (i.e., reduce compiling). Such reduced compiling can promote timely and/or enhanced conditioning of the print media in the second print media weight mode.

As illustrated at 554-4, the flow diagram can eject the print media at first print media ejection rate that is slower than a base print media ejection rate (i.e., reduce eject speed). As used herein, print media ejection rate refers to a rate at which print media is output from an output bin (e.g., a number of sheets of print media over a given time interval). Such reduced eject speed can promote timely and/or enhanced conditioning of the print media in the second print media weight mode.

As illustrated at 554-5, if the media weight is not equal to the second media weight (and instead is equal to a base media weight) the print media can be conditioned in accordance with base conditioning parameters (i.e., base print media conditioning), as described herein. From 554-4 or 554-5 the flow diagram can proceed to complete the print job (i.e., print job done), as illustrated at 554-6.

Figure 6:
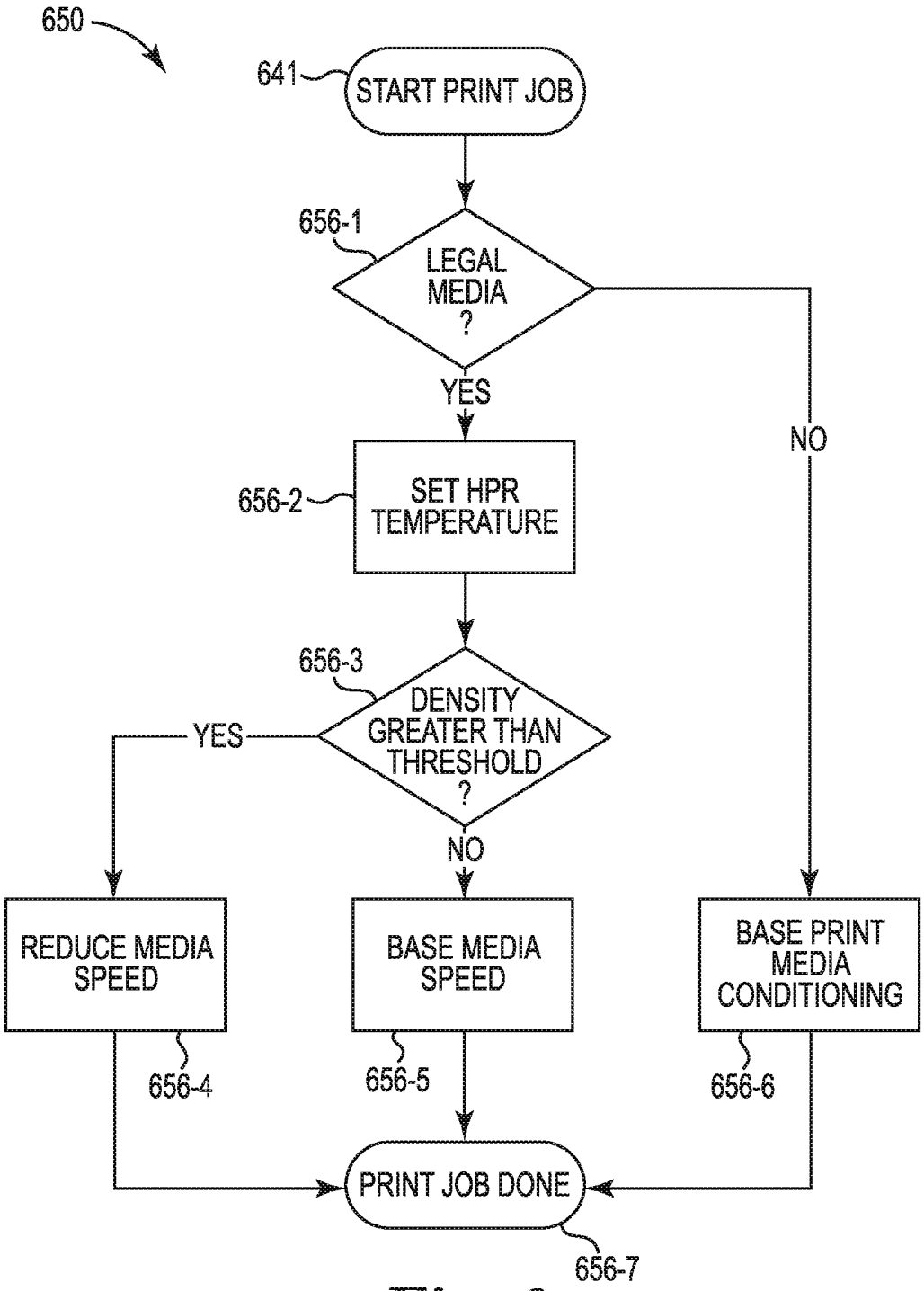
FIG. 6 is a block diagram of an example of a flow diagram of operation of a conditioning device in accordance with a legal media mode according to an example.

FIG. 6 is a block diagram of an example of operation of a flow diagram 650 of a conditioning device in accordance with a legal media mode according to an example. As mentioned, a type and/or weight of a print media can be sensed in advance of and/or responsive to starting a print job, among other possibilities such as sensing the type and/or weight of print media responsive to inputting of the print media into a feed of an imaging device. As illustrated at 641, the flow diagram can begin with receipt of a print job and/or other information related to a print job.

As illustrated at 656-1 the flow diagram can include determining whether a print media is legal media. For instance, print media have a width/length of legal media and/or optical characteristics or legal media, etc. can be determined to be print media), among other possibilities including an input by a user specifying a type of print media. In any case if the print media is determined to be legal print media ("yes"), the flow diagram can proceed to 656-2 and the HPR temperature can be set. For example, a temperature of the HPR can be set to a first temperature (e.g., 110° C.) greater than a base temperature (e.g., 80° C.) of the HPR. The increased temperature of the HPR can facilitate timely and/or enhanced conditioning of the print media in the legal print media mode (relative to conditioning the print media at the base temperature). Once the HPR temperature is set and/or the HPR reaches the set temperature the flow diagram can proceed to 656-3.

A printing fluid density score can be determined, as described herein. As illustrated at 656-3, a determination can be made whether the print media score is greater than a threshold. If the printing fluid density score is greater than the threshold ("yes"), the flow diagram can proceed to reduce the media speed (e.g., to 2 or 3 inches per second), as illustrated at 6564. As illustrated at 656-5 if the printing fluid density score is less than the threshold ("no"), the print media can be conditioned at a base media speed (e.g., 4 inches per second) that is greater than the reduced media speed. Such variations in speed of the print media can promote timely and/or enhanced conditioning of the print media (relative to other approaches that maintain the print media at a given speed regardless of fluid density).

As illustrated at 656-6, if the media is not determined to be legal media the print media can be conditioned in accordance with base conditioning parameters, as described herein. From 656-4, 656-5, or 656-6 the flow diagram can proceed to complete the print job (i.e., print job done), as illustrated at 656-7.

Figure 7:
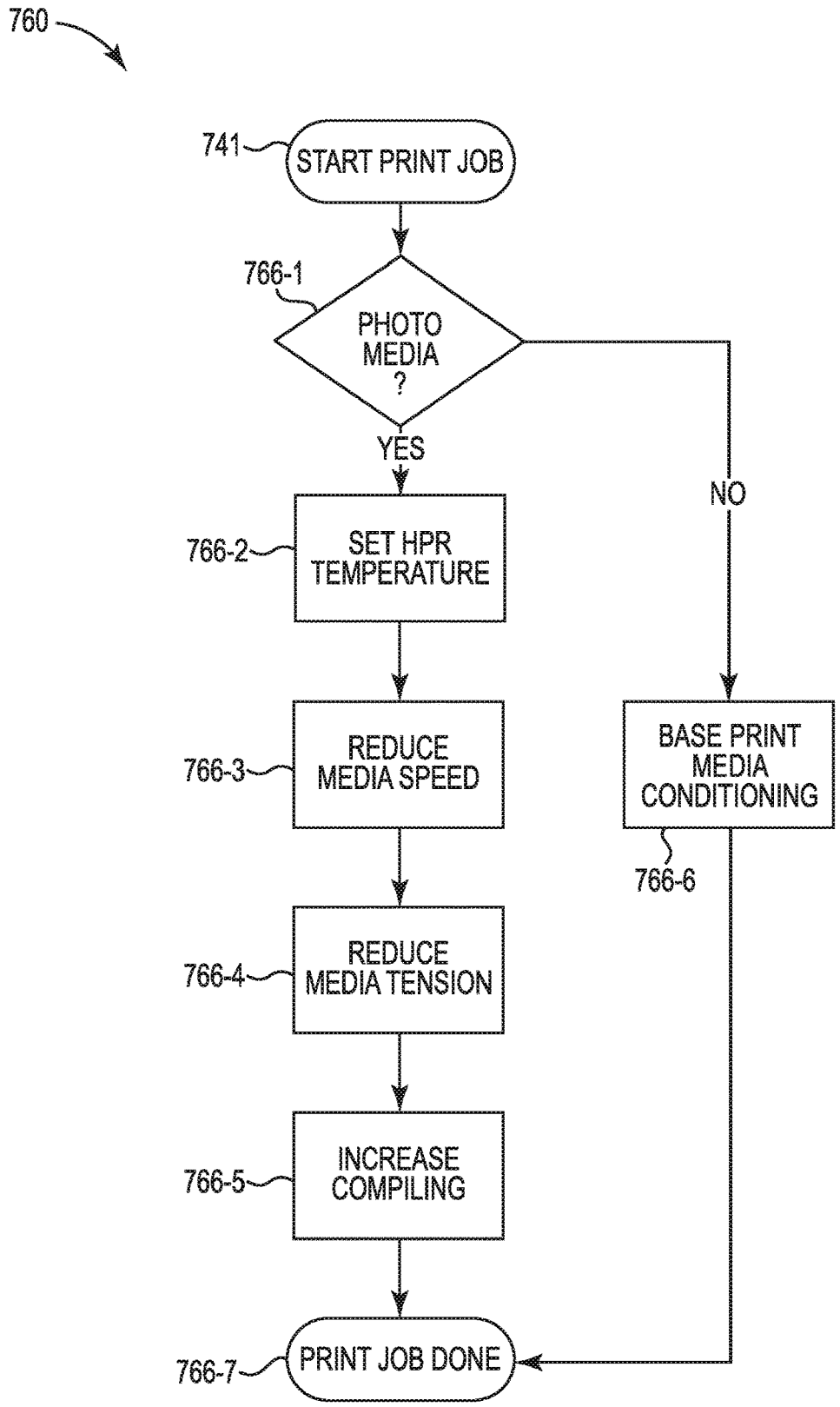
FIG. 7 is a block diagram of an example of a flow diagram of operation of a conditioning device in accordance with a photo media mode according to an example.

FIG. 7 is a block diagram of an example of a flow diagram 760 of operation of a conditioning device in accordance with a photo media mode according to an example. As illustrated at 741, the flow diagram can begin with receipt of a print job and/or other information related to a print job.

As illustrated at 766-1 the flow diagram can include determining whether a print media is photo media. For instance, print media have dimensions of photo media and/or optical characteristics (e.g., transparency) of photo media, etc. can be determined to be photo media), among other possibilities including an input by a user specifying a type of print media. If the print media is determined to be photo media ("yes"), the flow diagram can proceed to 766-2 and the HPR temperature can be set. For example, a temperature of the HPR can be set to a first temperature (e.g., 110° C.) greater than a base temperature (e.g., 80° C.) of the HPR. The increased temperature of the HPR can facilitate timely and/or enhanced conditioning of the print media in the photo media mode (relative to conditioning the print media at the base temperature). Once the HPR temperature is set and/or the HPR reaches the set temperature the flow diagram can proceed to 766-3.

As illustrated at 766-3, the media speed can be reduced (e.g., to 2 or 3 inches per second), as compared to a base media speed (e.g., 4 inches per second). As illustrated at 766-4 the flow diagram can apply a first amount of tension to the print media that is less than a base amount of tension (i.e., reduce media tension). For instance, in various examples no additional tension is applied to print media in the photo media mode. In any case, reduced media tension can promote timely and/or enhanced conditioning of the print media in the photo media mode.

As illustrated at 766-5, the flow diagram can compile the print media at a first compiling rate which is greater than a base rate of print media compiling (i.e., increase compiling). The increased compiling can promote timely and/or enhanced conditioning of the print media in the photo media mode.

As illustrated at 766-6, if the media is determined to not be photo media (e.g., based on having dimensions other than photo media, etc.) the print media can be conditioned in accordance with base conditioning parameters, as described herein. From 766-5 or 766-6 the flow diagram can proceed to complete the print job (i.e., print job done), as illustrated at 766-7.

Figure 8:
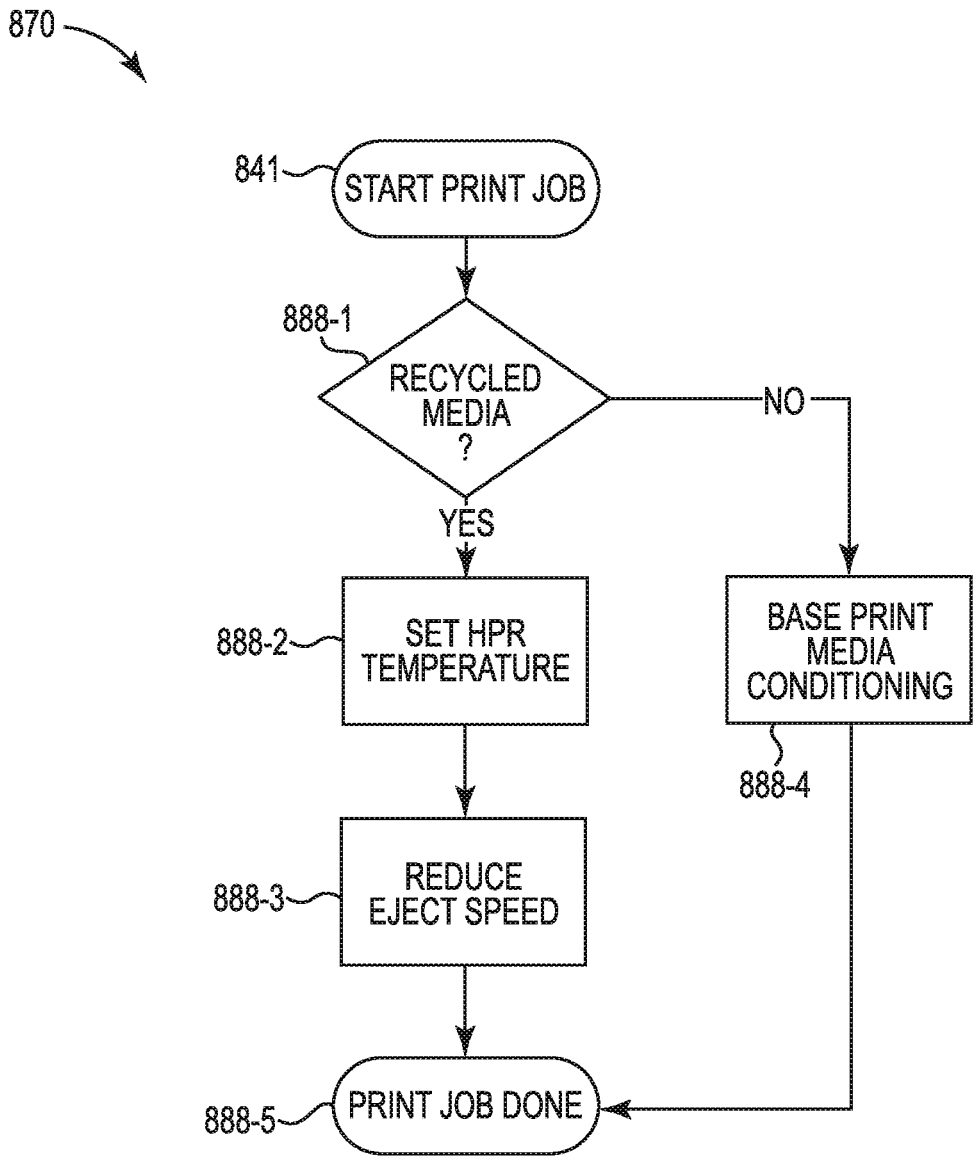
FIG. 8 is a block diagram of an example of a flow diagram of operation of a conditioning device in accordance with a recycled media mode according to an example.

FIG. 8 is a block diagram of an example of a flow diagram 870 of operation of a conditioning device in accordance with a recycled media mode according to an example. As mentioned, a flow diagram can begin with receipt of a print job and/or other information related to a print job, as illustrated at 841.

As illustrated at 888-1 the flow diagram can include determining whether a print media is recycled media. For instance, print media have dimensions of recycled media and/or optical characteristics (e.g., transparency) of recycled media, etc. can be determined to be recycled media), among other possibilities including an input by a user specifying a type of print media. If the print media is determined to be recycled media ("yes"), the flow diagram can proceed to 888-2 and the HPR temperature can be set. For example, a temperature of the HPR can be set to a first temperature (e.g., 110° C.) greater than a base temperature (e.g., 80° C.) of the HPR. The increased temperature of the HPR can facilitate timely and/or enhanced conditioning of the print media in the photo media mode (relative to conditioning the print media at the base temperature). Once the HPR set point temperature is set and/or the HPR reaches the set point temperature the flow diagram can proceed to 888-3.

As illustrated at 888-3, the flow diagram can eject the print media at first print media ejection rate that is slower than a base print media ejection rate (i.e., reduce eject speed). Such reduced eject speed can promote timely and/or enhanced conditioning of the print media in the recycled media mode.

As illustrated at 888-4, if the media is determined to not be recycled media the print media can be conditioned in accordance with base conditioning parameters (i.e., base print media conditioning), as described herein. From 888-3 or 888-4 the flow diagram can proceed to complete the print job (i.e., print job done), as illustrated at 888-5. As mentioned, in some examples, completion of the print job can include further processing and/or finishing (e.g., stapling, etc.).

In the foregoing detailed description of the disclosure, reference is made to the accompanying drawings that form a part hereof, and in which is shown by way of illustration how examples of the disclosure can be practiced. These examples are described in sufficient detail to enable those of ordinary skill in the art to practice the examples of this disclosure, and it is to be understood that other examples can be utilized and that process, electrical, and/or structural changes can be made without departing from the scope of the disclosure.

The figures herein follow a numbering convention in which the first digit corresponds to the drawing figure number and the remaining digits identify an element or component in the drawing. Similar elements or components between different figures can be identified by the use of similar digits. For example, 200 can reference element "20" in FIG. 2, and a similar element can be referenced as 300 in FIG. 3. Elements shown in the various figures herein can be added, exchanged, and/or eliminated so as to provide a plurality of additional examples of the disclosure. In addition, the proportion and the relative scale of the elements provided in the figures are intended to illustrate the examples of the disclosure and should not be taken in a limiting sense.

What is claimed:

1. A non-transitory-machine readable medium storing instructions executable by a processing resource to:

select a special media mode from a plurality of special media modes based on a weight or a type of print media;

set a set point temperature in accordance with the special media mode;

set a speed of the print media based on a fluid density of a fluid to be applied to the print media and the special media mode, wherein the fluid density is determined based on information associated with a print job; and set an operational characteristic of a conditioning procedure of a conditioning device to cause the conditioning device to condition the print media in accordance with the special media mode.

2. The medium of claim 1, wherein each special media mode of the plurality of special media modes corresponds to a respective weight of print media or a respective type of print media.

3. The medium of claim 2, wherein the plurality of special media modes include:

a first media weight mode; and a second media weight mode for print media having a different respective weight than a respective weight of print media of the first media weight mode.

4. The medium of claim 3, comprising instructions when set to the first media weight mode to cause the conditioning device to:

set a tension characteristic of the conditioning procedure to apply a first amount of tension to the print media that is less than a base amount of tension; and set a compiling rate characteristic of the conditioning procedure to compile the print media at a first compiling rate which is greater than a base rate of print media compiling.

5. The medium of claim 3, comprising instructions when set to the second media weight mode to cause the conditioning device to:

set an ejection rate characteristic of the conditioning procedure to eject the print media at a first print media ejection rate that is slower than a base print media ejection rate; and set a compiling rate characteristic of the conditioning procedure to compile the print media at a second compiling rate which is less than a base print media compiling rate.

6. The medium of claim 2, wherein the plurality of special media modes further include:

a legal media mode;

a photo media mode; and a recycled materials media mode.

7. The medium of claim 6, comprising instructions when set to the photo media mode to cause the conditioning device to:

set a tension characteristic of the conditioning procedure to apply a first amount of tension to the print media that is less than a base amount of tension; and set a compiling rate characteristic of the conditioning procedure to compile the print media at a first compiling rate which is greater than a base compiling rate.

8. The medium of claim 6, comprising instructions when set to the legal media mode to cause the conditioning device to:

responsive to the fluid density of the fluid applied to the print media being greater than a threshold, set a print media speed characteristic of the conditioning procedure to the speed of the print media to a first print media speed that is less than a base print media speed.

9. The medium of claim 3, comprising instructions when set to the first media weight to cause the conditioning device to:

responsive to the fluid density of the fluid applied to the print media being greater than a threshold, set a print media speed characteristic of the conditioning procedure to the speed of the print media to a first print media speed that is less than a base print media speed.

10. The medium of claim 6, comprising instructions when set to the recycled materials media mode to cause the conditioning device to set an ejection rate characteristic of the conditioning procedure to eject the print media at a first print media ejection rate that is slower than a base print media ejection rate.

11. The medium of claim 1, including instructions executable by the processing resource to maintain the conditioning device in the special media mode until a different weight or type of print media is detected.

* * * * *